US009300030B2

(12) United States Patent
Trojer et al.

(10) Patent No.: US 9,300,030 B2
(45) Date of Patent: Mar. 29, 2016

(54) SMALL-CELL ANTENNA ARRANGEMENT

(71) Applicant: Telefonaktiebolaget L M Ericsson (publ), Stockholm (SE)

(72) Inventors: Elmar Trojer, Täby (SE); Miguel Berg, Upplands Väsby (SE); Per-Erik Eriksson, Stockholm (SE); Chenguang Lu, Sollentuna (SE); Olof V. Tidblad, Solna (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 325 days.

(21) Appl. No.: 13/877,529

(22) PCT Filed: Feb. 25, 2013

(86) PCT No.: PCT/SE2013/050165
§ 371 (c)(1),
(2) Date: Apr. 3, 2013

(87) PCT Pub. No.: WO2014/129946
PCT Pub. Date: Aug. 28, 2014

(65) Prior Publication Data

US 2014/0240194 A1 Aug. 28, 2014

(51) Int. Cl.
*H01Q 21/00* (2006.01)
*H01Q 1/12* (2006.01)
*H01Q 1/00* (2006.01)

(52) U.S. Cl.
CPC ..... *H01Q 1/1221* (2013.01); *H01Q 1/007* (2013.01)

(58) Field of Classification Search
CPC ..... H01Q 1/1207; H01Q 1/1221
USPC ..... 343/872, 879
See application file for complete search history.

(56) References Cited

U.S. PATENT DOCUMENTS

| | | | |
|---|---|---|---|
| 6,295,036 | B1 | 9/2001 | Mata et al. |
| 2005/0245254 | A1 | 11/2005 | Hall |
| 2006/0252460 | A1 | 11/2006 | Chan |
| 2008/0303740 | A1 | 12/2008 | Schipper et al. |

OTHER PUBLICATIONS

Antenna Interface Standards Group, Control interface for antenna line devices, Standard No. AISG v2.0, Protocol Specification AISG v.2.0 Draft 4, Jun. 13, 2006, 41 pp.
International Search Report, PCT/SE2013/050165, Date of Mailing: Nov. 28, 2013; 5 pages.
Written Opinion of the International Searching Authority, PCT/SE2013/050165, Date of Mailing: Nov. 28, 2013; 5 pages.

*Primary Examiner* — Dieu H Duong
(74) *Attorney, Agent, or Firm* — Myers Bigel & Sibley, P.A.

(57) ABSTRACT

The present invention relates to a small-cell antenna arrangement. The antenna arrangement comprises an antenna mounting unit and an active antenna element. The antenna mounting unit is arranged with fastening means from which the active antenna element is detachable. Further, the antenna mounting unit is arranged with a signalling interface via which signals are arranged to be transferred between the active antenna element and a remotely located base station with which the antenna arrangement communicates. Moreover, the antenna mounting unit is arranged with an interface via which the active antenna element is powered.

22 Claims, 4 Drawing Sheets

(a) slide (b) bayonet (c) magnet

SMALL-CELL ANTENNA ARRANGEMENT

CROSS REFERENCE TO RELATED APPLICATION

This application is a 35 U.S.C. §371 national stage application of PCT International Application No. PCT/SE2013/050165, filed on 25 Feb. 2013, the disclosure and content of which is incorporated by reference herein in its entirety.

TECHNICAL FIELD

The invention relates to a small-cell antenna arrangement.

BACKGROUND

High-capacity radio systems require deployment of small cells, where a great number of antennas cover a given area. Whereas outdoor cell diameters in 2nd/3rd generation radio networks are in the area of 1-10 km, Long Term Evolution (LTE)/WiFi indoor cell diameters can be as low as 5-10 meters.

Traditionally, advanced network planning and optimization tools are used to determine suitable geographic radio base station (RBS)/antenna deployment locations and to tune network parameters such as sector azimuth, down tilt, power, etc. for optimum coverage, maximum data rate, and minimum cell interference. For ultra high-density small cell architectures—especially indoors—those tools are limited due to the potentially large scale of the network and plug-and-play (i.e. self-install) requirements. Remote radio heads are required to support low-cost installation and operation of high-density small-cell radio networks.

A remote radio head is an inexpensive, low-power radio unit which is remote from and connected to the "ordinary" base transceiver station (BTS) and is used to extend the coverage of the BTS (or NodeB/eNodeB) in indoor deployments such as enterprise offices, multi-tenant high rise buildings, shopping malls, airports, metros, tunnels, arenas, etc. The remote radio head generally connects to the BTS/NodeB/eNodeB via existing copper cabling such as Ethernet cable plants or coax cables. In main-remote deployments, several radio heads connect to a multi-port remote radio unit (RRU) which backhauls the baseband-signals to a base-band digital unit via common public radio interface (CPRI) physically transported over fiber links.

In existing small cell networks, pico or femto RBSs are fixedly installed to create small cell deployments. Typically, the base station functionality is integrated in small nodes and IP traffic is backhauled to the core network by the usage of small-formfactor (SFP) pluggables supporting different media types such as fiber/copper of different reach. Advantageously, if e.g. bandwidth requirements increase, or of different types of traffic are required, one or more SFP modules can be plugged in making the small-cell RBS highly scalable. Power is provided to the small-cell RBS from local grid.

Radio heads are targeted to be powered remotely from the RBS with which the radio head communicates via analog radio signal transmission on the copper cable. The remote power transfer is facilitated from power sourcing equipment (PSE) inside the RBS over Ethernet cabling towards a powered device (PD) at the radio head using Power-over-Ethernet (PoE). This allows deploying radio heads freely without local grid power.

Further, all-band radio heads are expensive as compared to using different radio heads for e.g. different radio bands, transmit power, radio standards, etc.

SUMMARY

An object of the present invention is to solve or at least mitigate a problem and to provide an improved small-cell antenna arrangement.

This object is attained according to the present invention by a small-cell antenna arrangement. The antenna arrangement comprises an antenna mounting unit and an active antenna element. The antenna mounting unit is arranged with fastening means from which the active antenna element is detachable. Further, the antenna mounting unit is arranged with a signalling interface via which signals are arranged to be transferred between the active antenna element and a remotely located base station with which the antenna arrangement communicates. Moreover, the antenna mounting unit is arranged with an interface via which the active antenna element is powered.

Advantageously, a small-cell antenna arrangement is provided where radio functionality is separated from more common functionality and powering. Thus, the (one or more) active antenna element can be attached to, and detached from the antenna mounting unit which typically is mounted onto a wall or in a ceiling on the premises where the small-cell antenna arrangement is deployed. Hence, if different radio functionality is requested such as a different radio band or a higher output power, the active antenna element can easily be detached from the antenna mounting unit and replaced by an active antenna element having different functionality. The powering supplied to the active antenna element via the antenna mounting can be easily adapted to the requirements of the new antenna element if required, and the new antenna element can straightforwardly communicate with the remotely located base station via the signalling interface. Thus, with the antenna arrangement of the present invention, radio functionality is physically separated from powering and more common functionality, and different variants of antenna elements can be easily attached. The signals transported over the signalling interface typically pertain to backhaul signalling, i.e. data/control signals transported to/from the radio base station on a cable plugged into the small-cell antenna arrangement via a connector in the antenna mounting unit and which are routed to the active antenna element through the signalling interface. Those signals can be e.g. analog or digital signals relating to frequency duplex multiplexing on an Ethernet cable. One or more active antenna elements can be included in the small-cell antenna arrangement.

In embodiments of the present invention, the signalling interface and the powering interface are either arranged in separate connectors or in the same connector.

In an embodiment of the present invention, the antenna mounting unit further comprises an external networking interface via which the signals between the active antenna element and the remotely located base station are transported. This external networking interface may be embodied in the form of a connector selected from the group comprising plain old telephony service (POTS) RJ11, Ethernet RJ45, Fiber SFP/SFP+, plastic optical fiber (POF) receptacles, threaded Neill-Concelman (TNC) connectors, SubMiniature version A (SMA) jackets (horizontally or vertically accessible), insulation-displacement connectors (IDC), terminal blocks, etc.

In a further embodiment of the present invention, the antenna mounting unit further comprises an external powering connector for powering the small-cell antenna arrangement. The powering interface via which the active antenna element is powered is connected to the external powering connector. The external powering connector may be embodied in the form of e.g. a Universal Serial Bus (USB), a micro USB, a mini USB (all in type A, B), cylindrical Deutsches Institut für Normung (DIN) connectors or Electronic Industries Association of Japan (EIAJ) connectors, etc. Again, jackets are horizontally or vertically accessible.

In another embodiment of the present invention, the antenna mounting unit comprises electronic devices arranged to be powered via the external powering connector.

In yet a further embodiment, the external powering connector is arranged to be supplied remotely with power delivery over copper-based Ethernet cables or from mains supply. Thus, the active antenna element as well as the antenna mounting unit may advantageously be powered from the remote base station via e.g. copper-based Ethernet or coax cables. This is for example advantageous in case local mains cannot easily be supplied to the antenna arrangement. In an alternative, the external powering connector is arranged to be supplied with power from the mains which is advantageous in case power cannot be supplied over cable. The external powering connector could be embodied in the form of IEEE802.3af/at PoE/+ or equal.

In still another embodiment, the antenna mounting unit further comprises AC/DC conversion circuitry and/or DC/DC conversion circuitry and/or voltage regulation circuitry for conversion and/or regulating the power supplied to the small-cell antenna arrangement via the external powering interface. Electronics in the active antenna element and the antenna mounting unit is likely to require different voltage/current levels than those supplied via the external power interface. Further, by placing the voltage and current conversion and regulation circuitry in the antenna mounting unit, the active antenna element can be exclusively dedicated to radio functionality.

It is noted that the invention relates to all possible combinations of features recited in the claims. Further features of, and advantages with, the present invention will become apparent when studying the appended claims and the following description. Those skilled in the art realize that different features of the present invention can be combined to create embodiments other than those described in the following.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
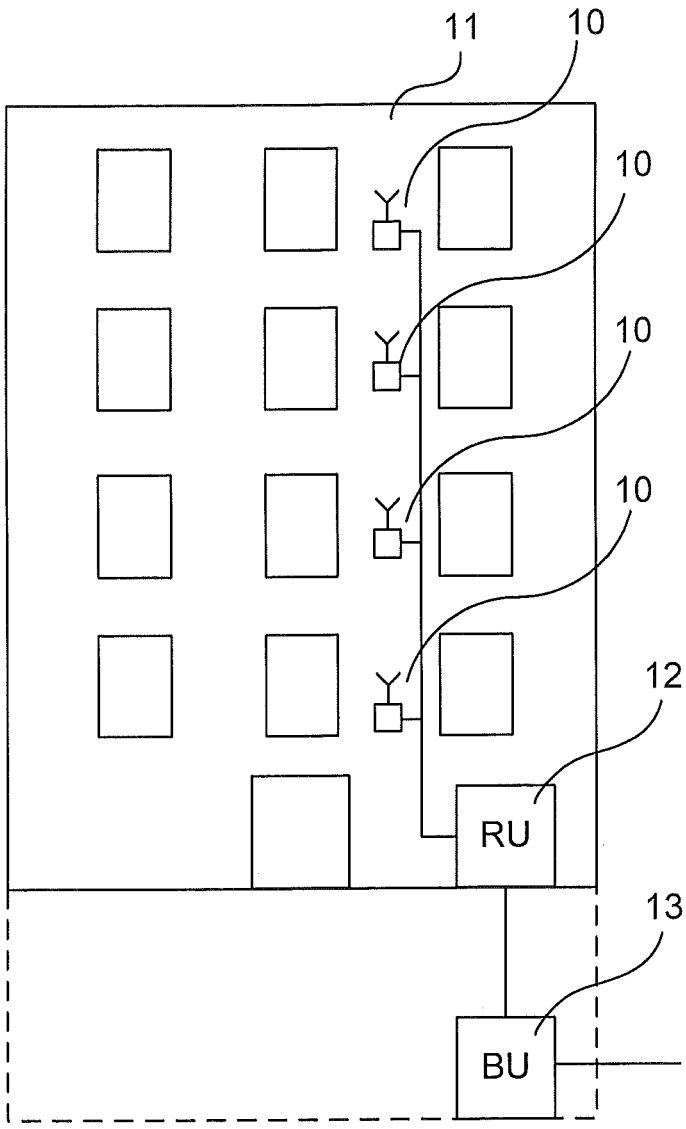
FIG. 1 illustrates configuration of a small-cell antenna arrangement according to the present invention placed in a building.

FIG. 1 illustrates configuration of a plurality of small-cell antenna arrangements 10 according to the present invention placed in a building where additional bandwidth capacity is needed. Thus, the small cell-antenna arrangement 10 acts as an extender of coverage. The small cell-antenna arrangement 10 communicates via wireless with close-range user equipment (UE) such as a mobile phone, a personal digital assistant (PDA), a smart phone, a tablet, a laptop, etc. The small cell-antenna arrangement 10 further communicates via e.g. copper cable with a radio unit (RU) 12. The RU 12 combines and aggregates signals between the small-cell antenna arrangements 10 and a baseband processing unit (BU) 13 e.g. placed in the basement of the building 11. Signals are typically transferred between the RU 12 and the BU 13 via fiber link. From a radio perspective, the small-cell antenna arrangements 10 perform up and down conversion between radio frequency (RF) signals and low-frequency intermediate frequency (IF) signals, and hence backhauls radio signals via copper cabling to the RU 12 and further to the BU 13. Thus, the RU 12 and the BU 13 together form an RBS communicating with the small-cell antenna arrangements 10 according to the present invention.

Figure 2:
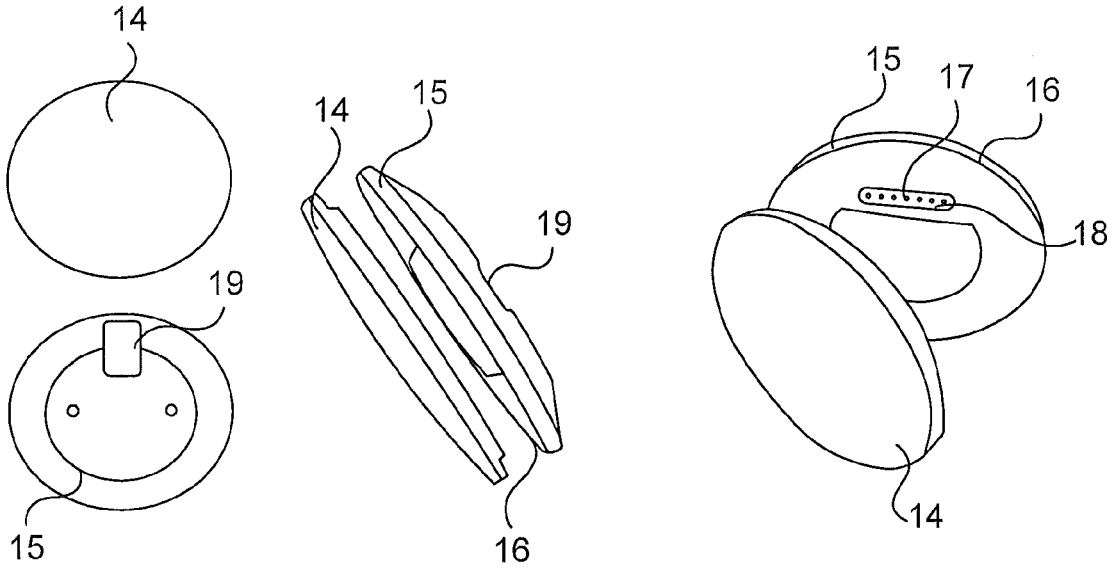
FIG. 2 shows the small-cell antenna arrangement of the present invention in three views

FIG. 2 shows the small-cell antenna arrangement of the present invention in three views. The small-cell antenna arrangement comprises an antenna mounting unit 15 typically fastened to a wall by means of attaching means such as screws, and an active antenna element 14 comprising radio functionality such as IF/RF conversion, frequency selection/generation/duplexing, amplification, antenna functions, control layer functionality, etc. The antenna mounting unit 15 is arranged with fastening means from/to which the active antenna element 14 is detachable/attachable. In the particular embodiment shown throughout the views of FIG. 2, the fastening means is implemented in the form of a magnet contact 16 extending along the periphery of the antenna mounting unit 15.

The antenna mounting unit 15 is arranged with a signalling interface 17 via which signals are arranged to be transferred between the active antenna element 14 and a remotely located base station with which the antenna arrangement communicates (i.e. the RBS of FIG. 1). The signalling interface 17 may carry signals such as analog/digital radio and control signals. Some signals may also be exchanged only locally between antenna mounting unit 15 and active antenna element 14, such as data bus, control bus, keying signals, etc.

The antenna mounting unit 15 is further arranged with a powering interface 18 via which the active antenna element 14 is powered externally from the antenna arrangement. The powering interface 18 may carry a multitude of signals, such as e.g. 48 V, +/−3.3 V, +/−5 V, 12 V, etc. In FIG. 2, the signalling interface 17 and the powering interface 18 is arranged in the same connector. However, these two interfaces 17, 18 could alternatively be arranged in separate connectors.

In a further embodiment of the present invention, with reference again to FIG. 2, the antenna mounting unit 15 of the small-cell antenna arrangement comprises an external networking connector 19 via which the signals between the active antenna element 14 and the remotely located base station are transported. Thus, the external networking connector 19 connects at least partly to the signalling interface 17. Further, the powering interface 18 is powered via an external powering connector 19 which in FIG. 2 is shared with the external networking connector. Voltage regulation and PoE powered device functionality in the antenna mounting unit 15 may be applied to adapt the input powering signals on the external powering connector 19 to the signals on the powering interface 18 to be used by the active antenna assembly 14. In case of remote powering such as PoE+, the same physical connector pins on external networking connector can be used for power transfer as well as signal transfer. Moreover, some signals on connector 19 may terminate in the antenna mounting unit 15 to allow signal exchange between the remote RBS and the antenna mounting unit. However, the external networking connector and the external powering connector could alternatively be arranged as two separate connectors.

Figure 3:
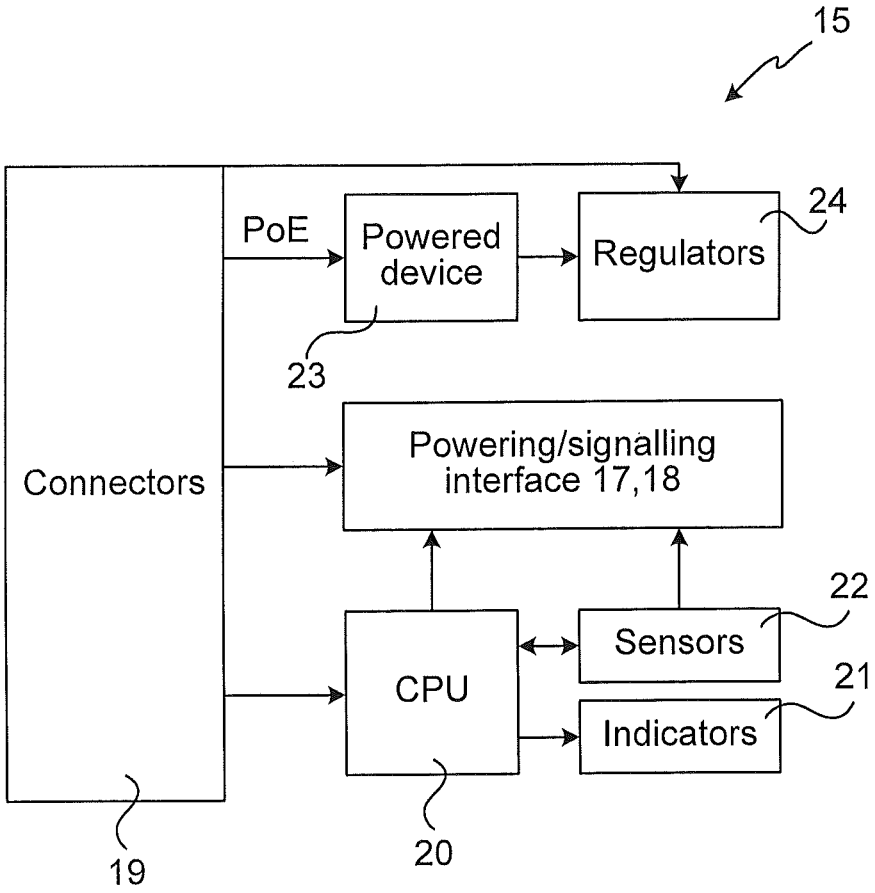
FIG. 3 shows a block scheme of the antenna mounting unit of the small-cell antenna arrangement according to embodiments of the present invention.

FIG. 3 shows a block scheme of the antenna mounting unit 15 of the small-cell antenna arrangement according to embodiments of the present invention. As previously described, the antenna mounting unit 15 comprises an external connector 19, which in this particular example houses both the external networking connector (used as a backhauling interface between the active antenna element and the RBS) and the external powering connector (for delivering power to the electronics of the antenna mounting unit and the active antenna element) either from local grid or remotely from the RBS via connector 19.

The antenna mounting unit 15 may for instance be equipped with a microprocessor 20 for controlling and coordinating transfer of signals to/from the small-cell antenna arrangement. Further, the antenna mounting unit 15 may be arranged with indicating devices 21 such as light sources, sound generators, identifiers, position indicating devices, visual status indicators, etc. Moreover, the antenna mounting unit 15 unit may be arranged with sensors 22 such as vibration sensors, tilt sensors, orientation sensors, positioning sensors (GPS receiver), environmental sensors, temperature sensors, humidity sensors, light sensors, smoke detection sensors, and the like.

The antenna mounting unit may also comprise remote/reverse/local power functionality such as AC/DC conversion circuitry or PoE powered device functionality 23 and/or DC/DC conversion circuitry and/or voltage regulation circuitry 24 for conversion and/or regulating the power supplied to the small-cell antenna arrangement via the connector 19. Power may also be provided from this circuitry back to the external power connector 19 to be used by other co-located equipment, such as dual radio-head deployments for multi-operator support. In case the RBS is located at a field site where it is difficult to locally power the RBS, reverse powering can advantageously be utilized for powering the RBS from the small-cell antenna arrangement. In such a case, the small-cell antenna arrangement may be supplied with power from local mains, which power further is supplied to the remotely located RBS via the external power connector 19.

When using Power-over-Ethernet, the external connector 19 transports both power and backhaul signals. Thus, the powering 17 and signalling 18 interface would in such a case coincide and be positioned in the same connector 19. The powered device 23 extracts a DC signal of typically 48 V from the Ethernet connector 19 and converts it to stable lower-voltage signals (e.g. 5 V and 12 V) to be used by the electronics in the antenna mounting unit 15 and the active antenna element 14.

In case other standards are used, the power signal provided via the connector 19 may be transferred directly to regulators 24 for appropriate stabilization.

Some or all of the components included in the antenna mounting unit 15 may be arranged to communicate via the powering and signalling interface 17, 18. For instance, the active antenna element may require to read status info/write configurations from/to the electronic devices of the antenna mounting unit 15, such as the CPU 20 or the sensors 21, for checking power status, sensor data, etc. The signalling interface 17 can be based on serial or parallel industry bus standards such as USB signalling or a serial interface such as RS232, etc, but can also be analog and/or proprietary. The CPU 20 can further be connected to an electrically erasable programmable read-only memory (EEPROM) comprised in the antenna mounting unit 15 containing e.g. information uniquely identifying each small-cell antenna arrangement, such as a serial number. The serial number may alternatively be factory-programmed in a non-writeable memory.

Further, as previously has been discussed, the signalling interface 18 (and connectors 19) advantageously carries radio signals between the active antenna element 14 and the RBS (embodied by the RU 12 and the BU 13 in FIG. 1). These radio signals are typically IF down-converted from RF communicated wirelessly to UEs.

Further, the antenna mounting unit may be equipped with protection circuitry such as e.g. line transformers and/or overvoltage protection.

In yet another embodiment of the present invention, the small-cell antenna arrangement 10 of the present invention comprises one or more further active antenna elements which are detachable/attachable from/to the antenna mounting unit 15. Advantageously, a plurality of active antenna elements could be used to create an antenna array out of individual active antenna elements or for Multiple Input Multiple Output (MIMO) applications or for multi-operator and/or multi-band support. The plurality of active antenna elements may share the powering and signalling interface 17, 18.

Figure 4:
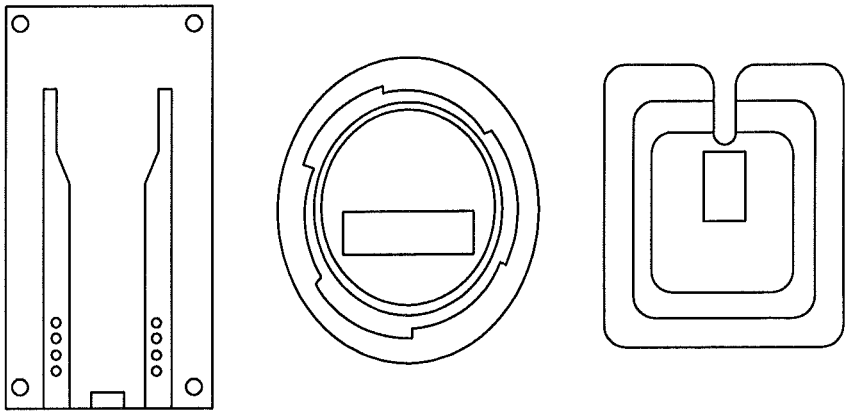
FIGS. 4*a-c* illustrate three further embodiments of the present invention, illustrating the fastening means for attaching/detaching the active antenna element to/from the antenna mounting unit.

FIGS. 4 *a-c* illustrate three farther embodiments of the present invention, illustrating the previously discussed fastening means for attaching/detaching the active antenna element 14 to/from the antenna mounting unit 15, FIG. 4 *a* shows the fastening means of the antenna mounting unit being a slide-in mechanism into which the active antenna element can slide in and out and thus be attached/detached. FIG. 4 *b* shows the fastening means of the antenna mounting unit being a bayonet socket from/to which the active antenna element can be attached/detached. Finally, FIG. 4 *a* shows (similar to FIG. 2) the fastening means of the antenna mounting unit being a magnetic holder from/to which the active antenna element can be magnetically detached/attached. The fastening means need to be tamper-proof as well as resilient to acts of vandalism.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A small-cell antenna arrangement comprising:

an antenna mounting unit; and at least one active antenna element;

the antenna mounting unit being arranged with fastening means from which the at least one active antenna element is detachable;

the antenna mounting unit further being arranged with a signalling interface between the antenna mounting unit and the at least one active antenna element via which signals are arranged to be transferred between the at least one active antenna element and a remotely located base station with which the small-cell antenna arrangement communicates; and the antenna mounting unit further being arranged with a powering interface between the antenna mounting unit and the at least one active antenna element via which the at least one active antenna element is powered, the fastening means comprising a mechanically detachable mechanism with which the at least one active antenna element can be fastened to the antenna mounting unit so as to be connected to the signalling interface and the powering interface, and can be unfastened from the antenna mounting unit so as to be disconnected from the signalling interface and the powering interface.

2. The small-cell antenna arrangement of claim 1, wherein the signalling interface and the powering interface are arranged in separate connectors.

3. The small-cell antenna arrangement of claim 1, wherein the signalling interface and the powering interface are arranged in the same connector.

4. The small-cell antenna arrangement of claim 1, wherein the signalling interface and/or the powering interface at least partly are arranged as a mechanical contact or as an inductive or capacitive coupling mechanism.

5. The small-cell antenna arrangement of claim 1, the antenna mounting unit further comprising:

an external networking connector via which the signals between the at least one active antenna element and the remotely located base station are transported.

6. The small-cell antenna arrangement of claim 1, the antenna mounting unit further comprising:

an external powering connector for powering the powering interface directly or via antenna mounting unit electronics.

7. The small-cell antenna arrangement of claim 6, the antenna mounting unit further comprising:

electronic devices arranged to be powered via the external powering connector.

8. The small-cell antenna arrangement of claim 7, the electronic devices being a microprocessor arrangement and/or indicating devices selected from a group of: light sources, sound generators, identifiers, position indicating devices, or visual status indicators.

9. The small-cell antenna arrangement of claim 7, the electronic devices being sensors selected from a group of: positioning sensors, vibration sensors, tilt sensors, orientation sensors, temperature sensors, humidity sensors, light sensors, or smoke detection sensors.

10. The small-cell antenna arrangement of claim 6, the external powering connector being arranged to be supplied with power from a power-over-copper cable or from a mains supply.

11. The small-cell antenna arrangement of claim 6, the antenna mounting unit further comprising:

power conversion circuitry for conversion of, and/or voltage regulation circuitry for regulation of, power supplied to the small-cell antenna arrangement from the external powering connector.

12. The small-cell antenna arrangement of claim 1, where either the antenna mounting unit or the at least one active antenna element or both contain identification/position information to identify the small-cell antenna arrangement locally and remotely from the remotely located base station.

13. The small-cell antenna arrangement of claim 1 comprising at least two active antenna elements being arranged to be detachable from the antenna mounting unit by operation of said fastening means, and wherein the signalling interface is arranged to transfer signals between the at least two active antenna elements and the remotely located base station with which the small-cell antenna arrangement communicates, and the powering interface is arranged to power the at least two active antenna elements.

14. The small-cell antenna arrangement of claim 13 wherein one active antenna element of the at least two active antenna elements operates at a frequency different than another one of the at least two active antenna elements.

15. The small-cell antenna arrangement of claim 1, wherein the mechanically detachable mechanism of the fastening means of the antenna mounting unit comprises a slide-in mechanism into which the at least one active antenna element can be slid to be fastened to the antenna mounting unit so as to be connected to the signalling interface and the powering interface, and out of which the at least one active antenna element can be slid to be unfastened from the antenna mounting unit so as to be disconnected from the signalling interface and the powering interface.

16. The small-cell antenna arrangement of claim 1, the fastening means of the antenna mounting unit comprises a bayonet socket from which the at least one active antenna element can be detached.

17. The small-cell antenna arrangement of claim 1, the fastening means of the antenna mounting unit comprises a magnetic holder from which the at least one active antenna element can be magnetically detached.

18. The small-cell antenna arrangement of claim 1 wherein the antenna mounting unit is configured as an assembly that provides the signaling interface and the powering interface upon an external surface of the antenna mounting unit, and wherein the fastening means is configured to fasten the at least one active antenna element to the external surface of the antenna mounting unit so as to connect the at least one antenna element to the powering interface and the signaling interface on the external surface of the antenna mounting unit.

19. A small-cell antenna arrangement comprising:

an antenna mounting unit; and at least one active antenna element, the antenna mounting unit being arranged with attaching means for attaching the at least one small-cell antenna element to an external surface of the antenna mounting unit, wherein the external surface of the antenna mounting unit to which the antenna mounting unit can be attached further comprises;

a signalling interface between the antenna mounting unit and the at least one active antenna element via which signals are arranged to be transferred between the at least one active antenna element and a remotely located base station with which the small-cell antenna arrangement communicates; and a powering interface between the antenna mounting unit and the at least one active antenna element via which the at least one active antenna element is powered, wherein the attaching means is configured to allow the dynamic attachment of the at least one active antenna element to the external surface of the antenna mounting unit so as to connect the signalling interface and the powering interface of the external surface of the antenna mounting unit to the at least one active antenna element, and wherein the attaching means is configured to allow the dynamic detachment of the at least one active antenna element from the external surface of the antenna mounting unit so as to disconnect the signalling interface and the powering interface of the external surface of the antenna mounting unit from the at least one active antenna element.

20. The small-cell antenna arrangement of claim 19 comprising at least two active antenna elements being arranged to be detachable from the antenna mounting unit by operation of said attaching means, and wherein the signalling interface is arranged to transfer signals between the at least two active antenna elements and the remotely located base station with which the small-cell antenna arrangement communicates, and the powering interface is arranged to power the at least two active antenna elements.

21. The small-cell antenna arrangement of claim 20 wherein one active antenna element of the at least two active antenna elements operates at a frequency different than another one of the at least two active antenna elements.

22. The small-cell antenna arrangement of claim 19, the antenna mounting unit further comprising:

an external powering connector on the antenna mounting unit configured to provide power to the powering interface, and wherein the external powering connector is arranged to be supplied with power from a mains supply, and the external powering connector is further configured to provide power to the remotely located radio base station.

* * * * *

UNITED STATES PATENT AND TRADEMARK OFFICE

CERTIFICATE OF CORRECTION

PATENT NO. : 9,300,030 B2
APPLICATION NO. : 13/877529
DATED : March 29, 2016
INVENTOR(S) : Trojer et al.

It is certified that error appears in the above-identified patent and that said Letters Patent is hereby corrected as shown below:

On the Title Page, in Item (74), under "Attorney, Agent, or Firm", in Column 2, Line 1, delete "Myers Bigel & Sibley, P.A." and insert -- Myers Bigel Sibley & Sajovec, P.A. --, therefor.

Specification

In Column 4, Line 6, delete "building" and insert -- building 11 --, therefor.

In Column 6, Line 33, delete "farther" and insert -- further --, therefor.

In Column 6, Line 36, delete "unit 15," and insert -- unit 15. --, therefor.

In Column 6, Line 42, delete "FIG. 4 a" and insert -- FIG. 4 c --, therefor.

Claims

In Column 8, Line 47, in Claim 19, delete "comprises;" and insert -- comprises: --, therefor.

Signed and Sealed this
Second Day of August, 2016

Michelle K. Lee

Michelle K. Lee
*Director of the United States Patent and Trademark Office*